US008960735B2

(12) United States Patent
Michael et al.

(10) Patent No.: US 8,960,735 B2
(45) Date of Patent: Feb. 24, 2015

(54) LATCH SYSTEM WITH INERTIAL LOCK MECHANISM

(75) Inventors: William J. Michael, Chino Valley, AZ (US); Reed A. Davis, Prescott, AZ (US); Patrick A. Hodan, Dewey, AZ (US)

(73) Assignee: Northland Products, Inc., Prescott, AZ (US)

( * ) Notice: Subject to any disclaimer, the term of this patent is extended or adjusted under 35 U.S.C. 154(b) by 88 days.

(21) Appl. No.: 13/613,356

(22) Filed: Sep. 13, 2012

(65) Prior Publication Data

US 2014/0070550 A1 Mar. 13, 2014

(51) Int. Cl.
*E05C 3/06* (2006.01)

(52) U.S. Cl.
USPC .... 292/199; 292/100; 292/216; 292/DIG. 11; 292/DIG. 22

(58) Field of Classification Search
CPC ..... E05B 85/12; E05B 85/26; E05B 65/0852; E05F 1/02; B65F 1/1615; B65F 1/1646; B65F 1/1623; B65F 1/163; B65F 1/16
USPC ..... 292/95, 96, 100, 101, 121, 122, 126, 292/128, 216, 219, 220, 226, 228, DIG. 11, 292/DIG. 22, 199; 220/315
See application file for complete search history.

(56) References Cited

U.S. PATENT DOCUMENTS 1,564,593 A 12/1925 Lawrence
4,155,584 A * 5/1979 Pracchia ..... 294/68.26
4,182,530 A 1/1980 Hodge
4,863,053 A 9/1989 Oberg
4,865,368 A * 9/1989 McCall et al. ..... 292/175
5,007,786 A 4/1991 Bingman
5,213,382 A * 5/1993 Dawdy et al. ..... 292/228
5,230,393 A 7/1993 Mezey
5,385,258 A 1/1995 Sutherlin
5,419,598 A * 5/1995 Kreitzer ..... 292/230
5,505,576 A 4/1996 Sizemore et al.
5,638,977 A 6/1997 Bianchi
5,673,810 A * 10/1997 Rothrock ..... 220/264
5,776,405 A 7/1998 Prout et al.
5,922,267 A 7/1999 Brescia et al.
6,327,879 B1 * 12/2001 Malsom ..... 70/97
6,547,289 B1 4/2003 Greenheck et al.

(Continued)

OTHER PUBLICATIONS

Bear Aware British Columbia, "Bear-Resistant Container", bear-resistant-bins.html, Jun. 24, 2010, pp. 1-3, British Columbia.

*Primary Examiner* — Kristina Fulton
*Assistant Examiner* — Christine M Mills
(74) *Attorney, Agent, or Firm* — Schmeiser, Olsen & Watts LLP; Lowell W. Gresham

(57) ABSTRACT

A latch system includes a catch member and a sear element engaged with the catch member when the catch member is in a latch position. A swing lever is in geared engagement with the sear element. When the latch system is subjected to an acceleration event, the swing lever pivots in one direction so that the sear element pivots in the opposite direction to move the sear element out of engagement with the catch member. The latch system may be installed on a container so that the catch member engages with a latch receptacle coupled to a hinged lid of the container. When the container experiences the acceleration event, the sear element disengages from the catch element and the hinged lid falls open thereby causing the catch member to pivot to the release position. The latch system automatically re-engages when the container is returned to its upright position.

19 Claims, 11 Drawing Sheets

(56) References Cited

U.S. PATENT DOCUMENTS

| | | | | |
|---|---|---|---|---|
| 6,550,824 | B1 | 4/2003 | Ramsauer | |
| 6,550,827 | B1 | 4/2003 | Tsujino | |
| 6,612,625 | B1 | 9/2003 | Barber et al. | |
| 6,644,906 | B2 | 11/2003 | Bayne | |
| 6,666,485 | B1 * | 12/2003 | Moret | 292/130 |
| 6,808,080 | B2 | 10/2004 | Spiers et al. | |
| 6,880,717 | B1 | 4/2005 | O'Conor | |
| 7,038,585 | B2 | 5/2006 | Hall et al. | |
| 7,048,347 | B1 | 5/2006 | Liu | |
| 7,086,557 | B2 | 8/2006 | Miller et al. | |
| 7,128,233 | B2 | 10/2006 | Hogan | |
| 7,128,515 | B2 | 10/2006 | Arrez et al. | |
| 7,277,009 | B2 | 10/2007 | Hall et al. | |
| 7,559,735 | B2 | 7/2009 | Pruteanu et al. | |
| 7,681,752 | B2 | 3/2010 | Moore | |
| 7,775,564 | B2 | 8/2010 | Moore | |
| 7,871,233 | B2 | 1/2011 | Arrez et al. | |
| 8,056,943 | B2 | 11/2011 | Scheffy et al. | |
| 8,146,769 | B2 | 4/2012 | Hogan | |
| 8,191,953 | B2 | 6/2012 | Simon et al. | |
| 8,550,282 | B1 * | 10/2013 | Libhart et al. | 220/234 |
| 2002/0030595 | A1 | 3/2002 | Kasik | |
| 2007/0175898 | A1 | 8/2007 | Craft et al. | |
| 2007/0175910 | A1 | 8/2007 | Hogarth et al. | |
| 2011/0031765 | A1 * | 2/2011 | Vazquez et al. | 292/217 |
| 2012/0006838 | A1 | 1/2012 | Michael et al. | |

* cited by examiner

LATCH SYSTEM WITH INERTIAL LOCK MECHANISM

TECHNICAL FIELD OF THE INVENTION

The present invention relates generally to latch systems. More specifically, the present invention relates to a latch with inertial lock mechanism configured to selectively restrict access into a container.

BACKGROUND OF THE INVENTION

A large variety of latches exist which include mating mechanical parts that engage to fasten two or more objects or surfaces together while allowing for the regular or eventual separation of the objects or surfaces. For example, a latch may be used to engage a lid to a container, a door to a cupboard, a gate to posts, and so forth. Many latches may additionally include locking mechanisms that are selectively locked to prevent ingress to or egress from the particular objects to which the latches are coupled.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION

Figure 1:
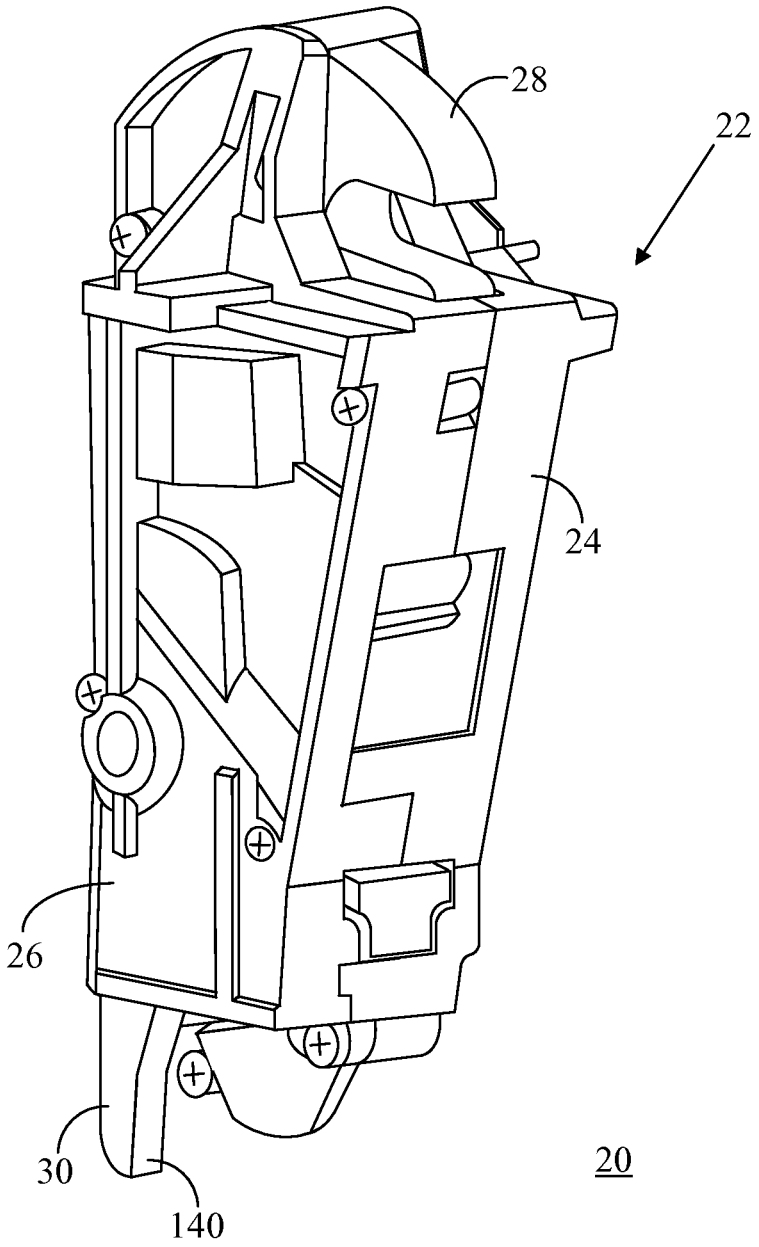
FIG. 1 shows a perspective view of a latch system in accordance with an embodiment.

Latches are used on a multitude of enclosures for selectively allowing ingress to or egress from such enclosures. Increasingly, latches are being incorporated with refuse containers in an attempt to prevent animals from accessing food and food-containing refuse placed in these containers by humans. Indeed such refuse often attracts the attention of animals in areas adjacent to animal habitats. Animals, such as bears, have a keen sense of smell and can easily detect food which has been discarded in containers left outdoors such as refuse bins and storage lockers. Once food has been discovered in such areas, the animals often return to these outdoor containers in the hope of finding additional food.

Animals in pursuit of a readily available source of food are problematic to human populated areas. For example, animals sometimes enter homes, garages, or even vehicles in search of food. Some animals, and bears in particular, can do significant property damage due to their size and strength. Furthermore, animals entering human inhabited areas can become injured or killed by moving vehicles, electrical lines, and other human accoutrements. Still further, these animals can lose their wariness towards humans, making them a potential threat to humans. Indeed, allowing bears to get into the garbage is one of the leading causes of bear-human encounters. Thus, to protect people, property, and the animals themselves, it is desirable to inhibit animals from accessing containers in which refuse and food are stored.

Various attempts have been made to prevent animals from getting into outdoor refuse containers and food storage lockers. For example, refuse containers are sometimes stored inside sturdy locked buildings, in roofed chain link enclosures, and so forth. Unfortunately, food refuse in an enclosure still gives off odors that attract bears and other wildlife. Thus, it is critical that such an enclosure be locked and that the enclosure is sufficiently sturdy to dissuade a persistent intruder.

In addition, or alternatively, refuse containers may be outfitted with a latch system to prevent an animal from opening the container. These latch systems can be problematic, however, because they can be difficult for a user to manipulate. Furthermore, these latch systems typically require the user to unlatch and subsequently re-engage the latch after use. If the latch is not re-engaged the container is not protected from animal access. Additionally, some latch systems can still be opened by animals through luck, persistence, or cleverness.

Another approach is to build the container using heavy, reinforcing components designed to inhibit animals from physically damaging the container in order to gain access. These reinforcing components can make the container undesirably heavy and unwieldy to move. In addition, these heavy, reinforcing components can cause premature damage, such as failure of the container hinges after repeated use.

In an effort to control costs associated with refuse collection, many municipalities are implementing "fully-automated collection" techniques. Fully-automated collection involves the use of a truck with an automated, mechanical gripping arm to lift a specially-designed container from the curbside, dump the container contents into the truck, and return the container to the curbside. Such a system typically requires only one person to operate because the truck driver controls the gripping arm from the cab of the truck. In contrast, traditional collection systems require one or two laborers and a driver to collect refuse.

Fully-automated collection relies on the cooperation of the residents to place the refuse containers in the proper location and position for collection. Unless the resident places the refuse container in the proper location at the moment that the truck approaches, a container without a latch system is vulnerable to animals while the container awaits refuse collection. A container with a latch system is also problematic because when the container is placed in the proper location, it must be unlatched so that the contents of the container will be successfully emptied. Accordingly, a container with a disengaged latch system is also vulnerable to animals while the container awaits refuse collection. Alternatively, the refuse vehicle operator may exit the truck to disengage the latch system. However, such a procedure is undesirably inconvenient and time consuming. A container using heavy, reinforcing components may be difficult for a resident to place in the proper location and may not conform with the size, shape, and weight requirements needed to safely function with the automated, mechanical arm.

Embodiments entail a latch system for an enclosure, such as a container with a lid, and an apparatus that includes a container and closure element having the latch system incorporated therein. The latch system includes an inertial lock mechanism that automatically engages so that a user need not deliberately re-engage the latch after manually disengaging it. Additionally, the latch system automatically unlatches when the container is sharply lifted or briefly shaken.

In an example, the latch system is implemented with a container to produce an animal-resistant refuse container. Such a refuse container is useful for receiving and holding garbage, recyclable items, and the like. The refuse container with the latch system incorporated therein is configured to inhibit an animal, and especially large animals such as bears, peccaries, and the like, from accessing the contents of the container. When the container is tilted or tipped, the inertial lock mechanism will remain locked to prevent an animal intruder from access into the container. However, lift action imparted on the container by an automated, mechanical arm of a refuse truck is sufficient to unlock the inertial lock mechanism of the latch system so that the contents of the container can be emptied during automated collection. Although the latch system is directed towards inhibiting access of animals to a refuse container used for automated collection, embodiments of the latch system may be applied to inhibit access of animals in general to containers. Additionally, the latch system may be implemented to allow controlled access to a multitude of container designs, cupboards, gates, and the like.

FIG. 1 shows a perspective view of a latch system 20 in accordance with an embodiment. In an embodiment, latch system 20 is implemented within a refuse container (discussed below) to enable selective access of the container by humans and to largely prevent access of the contents of the container by animals. In general, latch system 20 includes a housing 22 having first housing element 24 and a second housing element 26 configured to be engaged with first housing element 24. Multiple components of latch system 20 reside within housing 22. However, at least a portion of a catch member 28 extends out of the top of housing 22 and at least a portion of a manual actuation lever 30 extends from the bottom of housing 22. The interconnection and function of the components of latch system 20, including catch member 28 and manual actuation lever 30, will be described in detail below.

Figure 2:
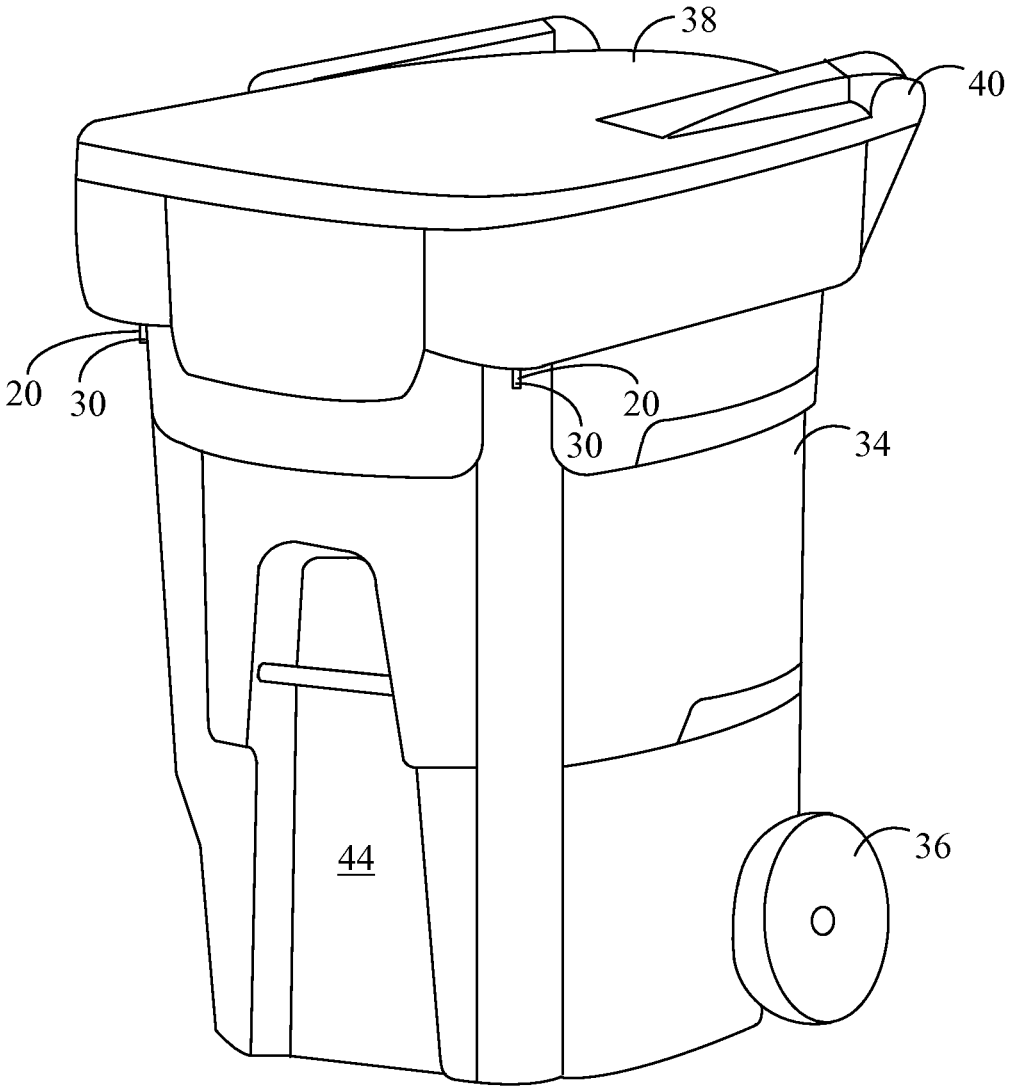
FIG. 2 shows a perspective view of an apparatus that includes an enclosure system in which the latch system of FIG. 1 may be utilized.

FIG. 2 shows a perspective view of an apparatus 32 that includes an enclosure system in which latch system 20 is incorporated. In general, the enclosure system includes a container 34 mounted on wheels 36 (of which one is visible), and a closure element, e.g., a lid 38 attached to container 34. Lid 38 may be pivotally attached to a handlebar 40 so that lid 38 can be opened to access an interior of body container 34. Apparatus 32 further includes at least one latch system 20 secured in container 34 and at least one latch receptacle 42 (visible in FIGS. 5 and 6) secured in lid 38.

Figure 5:
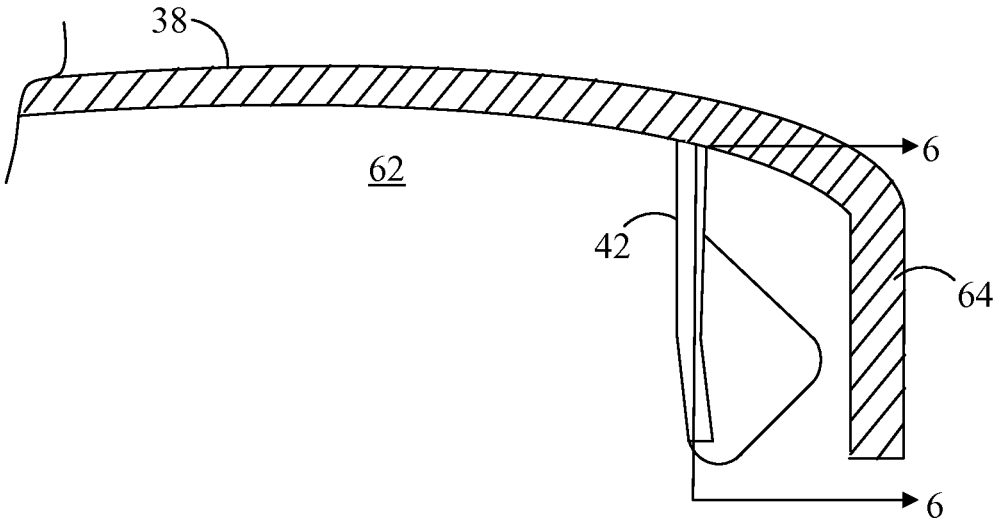
FIG. 5 shows a partial sectional view of a lid of the apparatus.

In an embodiment, apparatus 32 includes two latch systems 20 and, correspondingly, two latch receptacles 42 (FIG. 5). However, as shown in FIG. 2, only manual actuation levers 30 of latch systems 20 are visible. Each of latch systems 20 and their corresponding latch receptacles 42 are spaced apart from one another and may be located at an exterior front surface 44 of container 34 of apparatus 32, for example, at opposing front corners of exterior front surface 44. Each latch system 20 functions cooperatively with its corresponding latch receptacle 42 so that lid 38 is secured to container 34 to inhibit intrusion into apparatus 32, as will be discussed in greater detail below. In addition, latch systems 20 can be reliably actuated by an upward lift action produced by an automated collection refuse pickup vehicle to automatically disengage them from latch receptacles 42, as will also be discussed in greater detail below.

Figure 3:
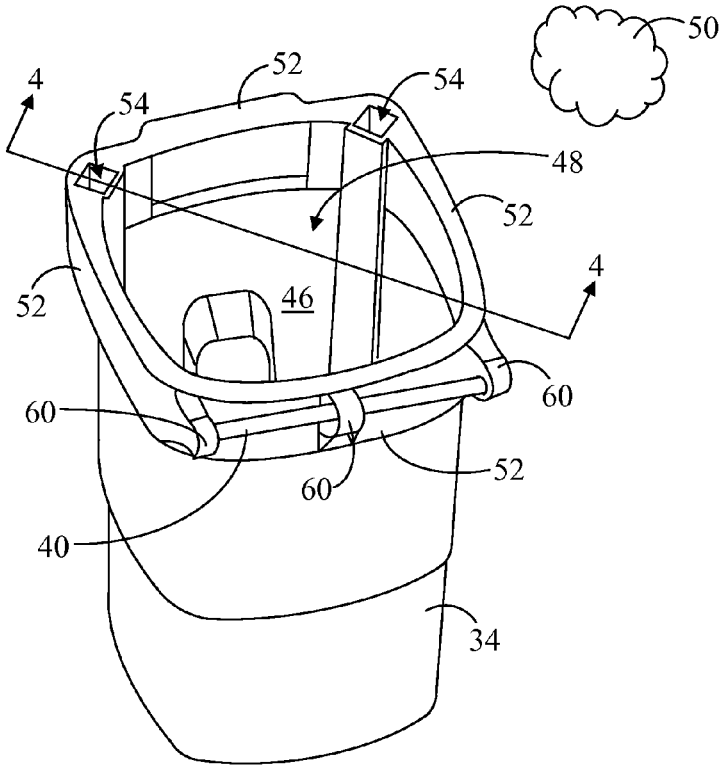
FIG. 3 shows top perspective view of a container of the apparatus of FIG. 2.
Figure 4:
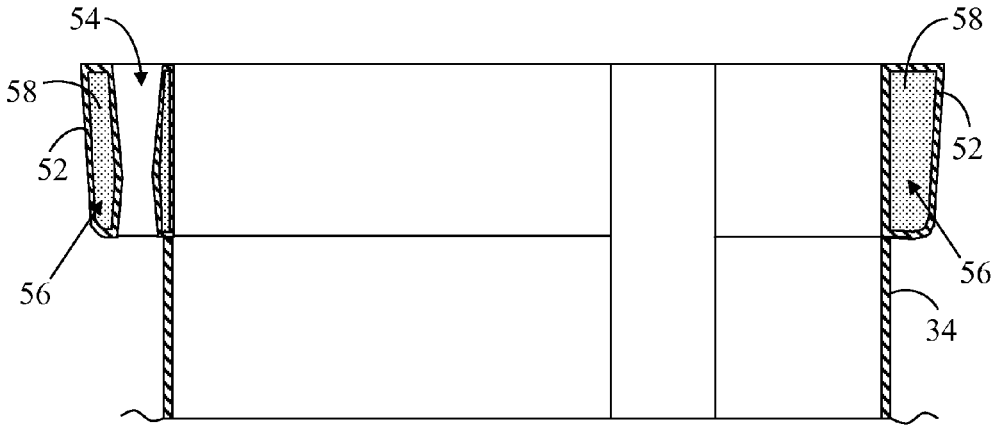
FIG. 4 shows a partial sectional view of the container along section lines 4-4 of FIG. 3.

Referring to FIGS. 3-4 in connection with FIG. 2, FIG. 3 shows a top perspective view of container 34 of apparatus 32 and FIG. 4 shows a partial sectional view of container 34 along section lines 4-4 of FIG. 3. Container 34 is a walled structure having an interior volume 46 and an opening 48 for input of refuse 50 into interior volume 46. Container 34 may be formed from thermoplastic material, such as, polyethylene, polypropylene, acrylonitrile butadiene styrene (ABS), polyvinyl chloride (PVC), nylon, and the like. Container 34 may be manufactured utilizing a rotational molding process. A rotational molding technique and a thermoplastic material may be desirable for making container 34, due to cost effective production, as well as, high durability, corrosion resistance, and light weight of the finished product. In alternative embodiments, container 34 may be manufactured using another suitable molding process, such as injection molding, blow molding, and so forth.

Container 34 further includes a circumferential rim 52 encircling opening 48, and passages 54 are formed in circumferential rim 52 of container 34 during the rotational molding manufacturing process. At least a portion of latch system 20 may be housed in each passage 54. Passages 54 function to protect latch system 20 from an animal intruder and from inclement weather conditions. In an embodiment, an interior cavity 56 is formed in circumferential rim 52 and is filled with a foam material 58. Foam material 58 provides reinforcement at circumferential rim 52 in order to withstand damage from teeth and claws of an animal intruder. Container 34 may be further provided with reinforcing areas, relief areas, and so forth to provide the desired strength and stiffness to container 34. In addition, handle supports 60 and handlebar 40 can be integrally-formed with and at the same time as the formation of container 34. Handle supports 60 support the laterally extending cylindrical handlebar 40 to which lid 38 may be pivotally attached.

Figure 6:
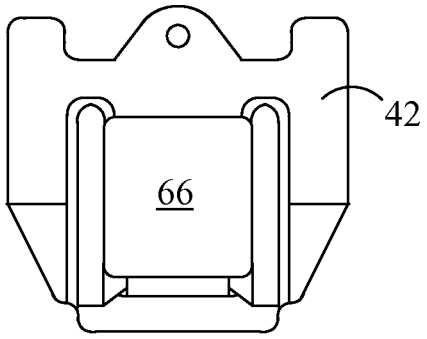
FIG. 6 shows a particular view of one of the latch receptacles along section lines 6-6 of FIG. 5.

Referring to FIGS. 5-6 in connection with FIG. 2, FIG. 5 shows a partial sectional view of lid 38 of apparatus 32 and FIG. 6 shows a partial view of one of latch receptacles 42 along section lines 6-6 of FIG. 5. Like container 34 (FIG. 2), lid 38 may be formed from thermoplastic material using a rotational molding process.

Lid 38 may be slightly convex or dome-shaped. This convex shape produces a cavity 62 in the underside of lid 38 that is surrounded by a circumferential lip 64 of lid 38. Latch receptacles 42 are housed in cavity 62 and may be secured in lid 38 using any of a variety of bracket and/or fastener configurations (not shown). Alternatively, latch receptacles 42 may be integrally formed in lid 38 during fabrication of lid 38. When lid 38 is closed on container 34 (FIG. 2), latch receptacles 42 are protected from animal intruders, as well as inclement weather conditions. In an embodiment, each latch receptacle 42 includes a receiver, or latch strike, to which a catch member 28 (FIG. 1) of latch system 20 attaches. That is, a portion of catch member 28 extends into an opening 66 of latch receptacle 42. Latch receptacles 42 may take on various shapes (e.g., ring-shaped) and sizes to mate or otherwise attach with its associated catch member 28.

The following FIGS. 7-10 illustrate the various components of latch system 20 (FIG. 1) and demonstrate their assembly and interconnections to produce latch system 20. These various components will be described progressively in connection with FIGS. 7-10. The cooperative function of the various components after latch system 20 is assembled will be described in detail in connection with the subsequent FIGS. 11-17.

Figure 7:
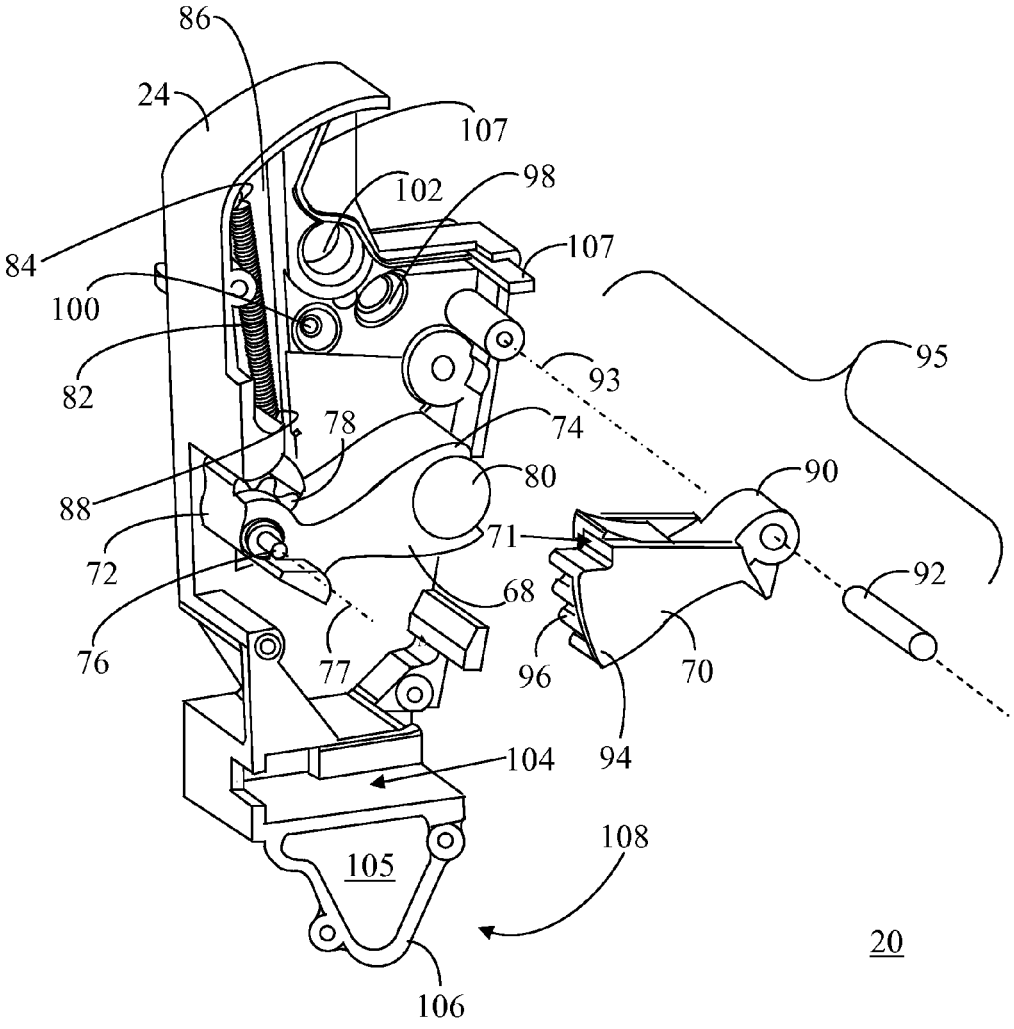
FIG. 7 shows an exploded perspective view of a portion of the latch system.

FIG. 7 shows an exploded perspective view of a portion of latch system 20. In this illustration, some components of latch system 20 and their interaction with first housing element 24 are visible. Latch system 20 includes a swing lever 68 and a sear element 70 configured for geared engagement with swing lever 68. Additionally, sear element 70 includes a latch area 71 that is configured for contact with an engagement area (discussed below) of catch member 28 (FIG. 1) to prevent catch member 28 from moving.

Swing lever 68 includes a first end 72 and a second end 74, where second end 74 opposes first end 72. First end 72 of swing lever 68 is coupled with first housing element 24 via a pivot shaft 76. Pivot shaft 76 defines a pivot axis 77, i.e., an axis of rotation, about which swing lever 68 is able to pivot. Swing lever 68 further includes gear teeth 78 located at first end 72 proximate pivot shaft 76. Second end 74 of swing lever 68 includes a weight 80 that provides resistance to an acceleration event (discussed below) that causes swing lever 68 to pivot about the pivot point at pivot shaft 76. Latch system 20 further includes a spring 82 having one end 84 coupled to an inner surface 86 of first housing element 24 and another end 88 coupled to swing lever 68.

One end 90 of sear element 70 is coupled with first housing element 24 via another pivot shaft 92. Thus, pivot shaft 92 defines a pivot axis 93 about which sear element 70 can pivot. The opposite end 94 of sear element 72 includes gear teeth 96. Gear teeth 96 of sear element 70 engage with gear teeth 78 of swing lever 68. Thus, when swing lever 68 pivots about pivot axis 77 in one direction, the geared engagement of sear element 70 with swing lever 68 will cause sear element 70 to pivot about pivot axis 93 in the opposite direction. In particular, when latch system 20 is subjected to an acceleration event (discussed below), weight 80 provides resistance to this acceleration event to cause swing lever 68 to pivot about pivot axis 77 and thereby cause sear element 70 to pivot about pivot axis 93. As such, swing lever 68 with weight 80 and sear element 70 are referred to herein as an inertial locking mechanism 95 of latch system 20 that prevents catch member 28 from pivoting under particular circumstances.

First housing element 24 can include additional features. In particular, at least two detents 98 and 100 are formed in inner surface 86 of first housing element 24. In addition, a pivot shaft receiver 102 is formed in inner surface 86. Detents 98 and 100 and pivot shaft receiver 102 function cooperatively with catch member 28 (FIG. 1), and will be discussed below. Additionally, first housing element 24 includes a receptacle 104 configured to hold a retainer element (discussed below) and a pocket 106 having a cavity 105. Pocket 106 forms part of an actuation lock 108 (again discussed below) for latch system 20. One or more sealing strips 107 may be included to largely prevent the entry of debris and/or water into housing 22 (FIG. 1) of latch system 20.

Figure 8:
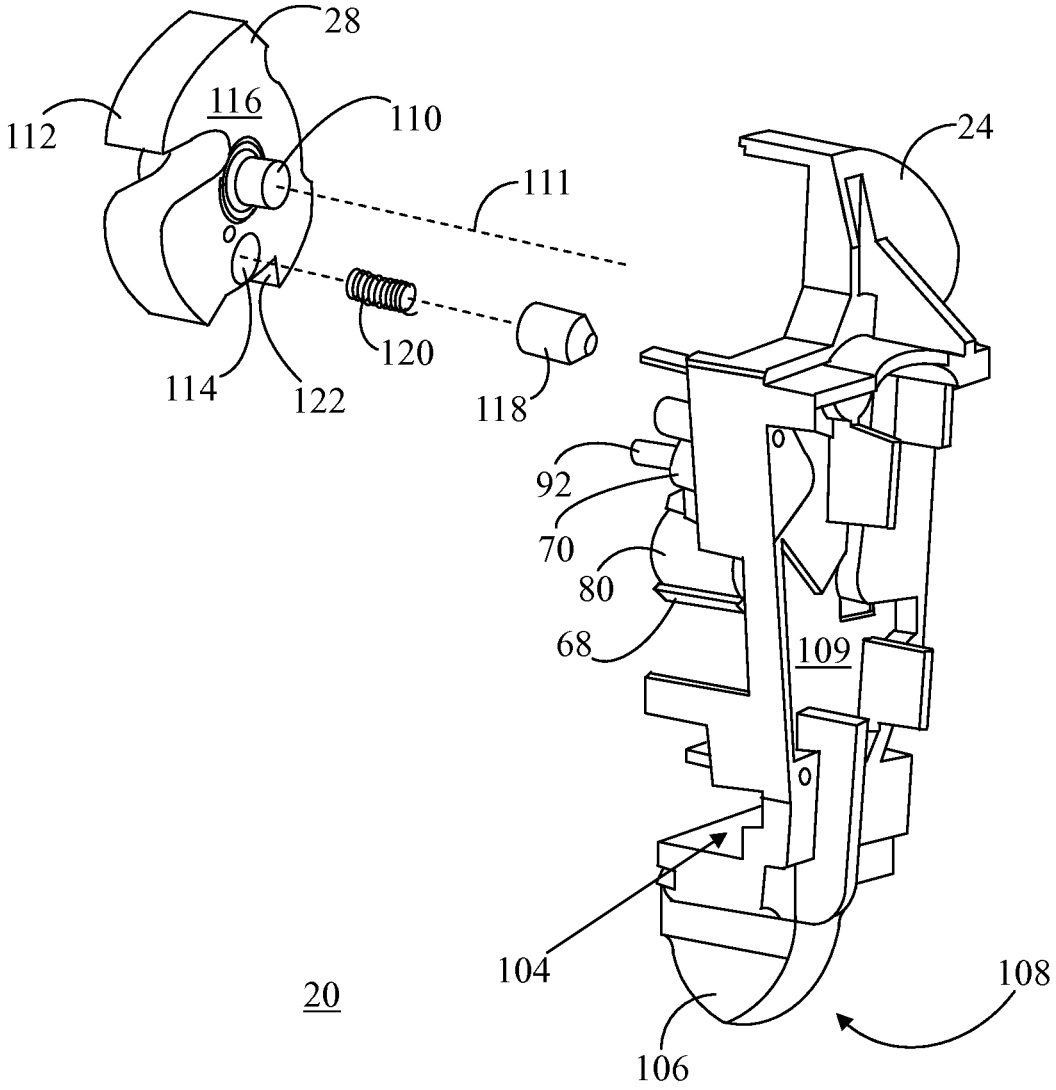
FIG. 8 shows another exploded perspective view of a portion of the latch system.

FIG. 8 shows another exploded perspective view of a portion of latch system 20. In this illustration, an outer surface 109 of first housing element 24 is visible. Additionally, some components of latch system 20 and their interconnection with first housing element 24 are visible. As shown, swing lever 68 and sear element 70 have been coupled to first housing element 24 via their respective pivot shafts 76 (FIGS. 7) and 92. Additionally, a portion of receptacle 104 and pocket 106 of actuation lock 108 are visible.

Catch member 28 includes a catch pivot 110 configured to engage with pivot shaft receiver 102 (FIG. 7) formed in first housing element 24. Catch pivot 110 enables pivotable movement of catch member 28 about a pivot axis 111. Catch member 28 further includes a hook 112 configured to engage with latch receptacle 42 (FIG. 5). An indentation 114 is formed in a lateral surface 116 of catch member 28. A plunger 118 is installed in indentation 114 and a spring 120 is interposed between plunger 118 and indentation 114 so that plunger 118 is outwardly spring biased. Once installed, plunger 118 can interconnect with detents 98 and/or 100 (FIG. 7) as catch member 28 pivots to more reliably control the locking, unlocking, and pivoting movement of catch member 28.

The perspective view of catch member 28 further reveals an engagement area 122 formed as a notch at a lower region of catch member 28. Engagement area 122 of catch member 28 and latch area 71 (FIG. 7) of sear element 70 contact one another to retain catch member 28 in a latched, i.e., locked position.

Figure 9:
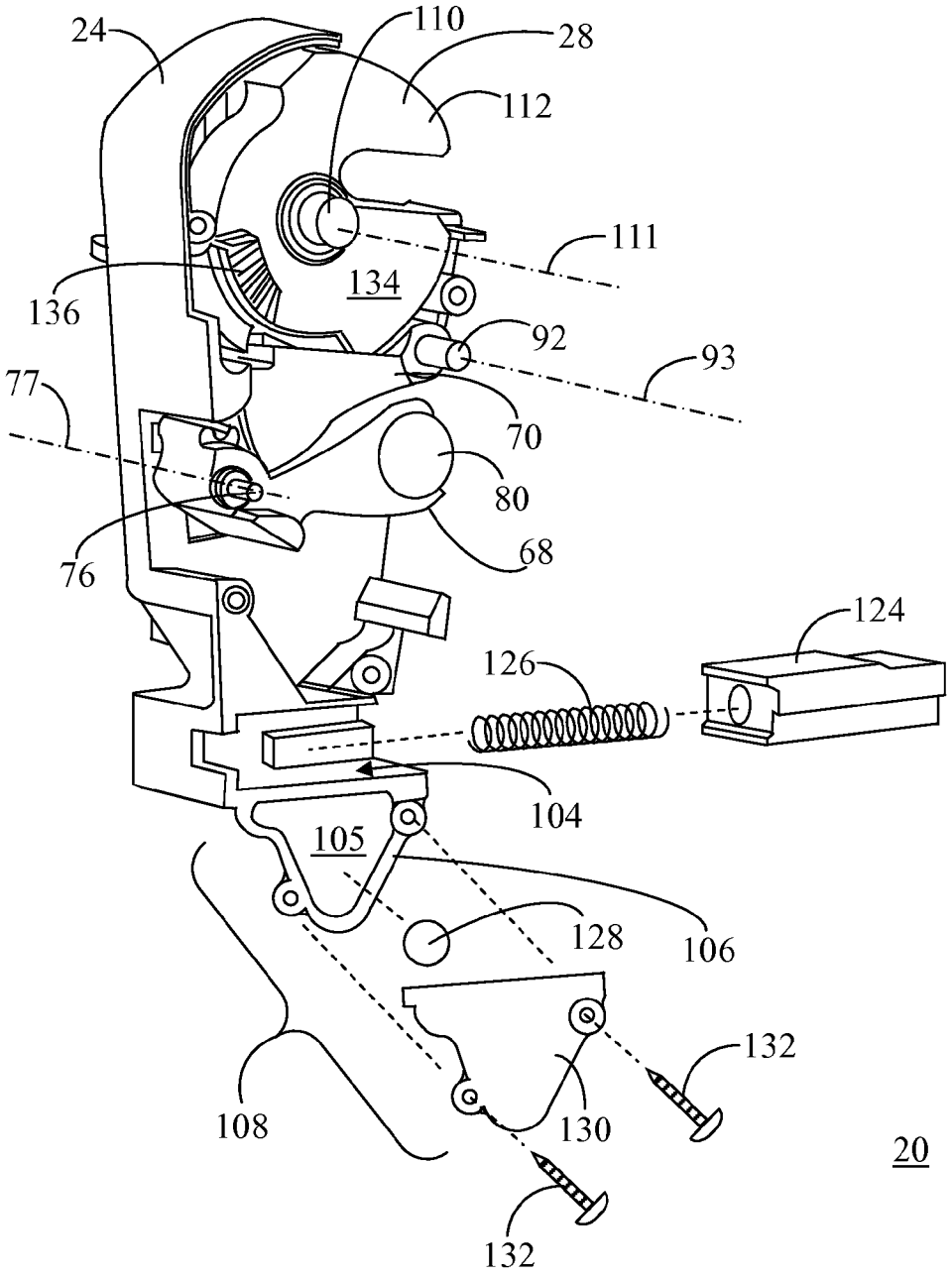
FIG. 9 shows another exploded perspective view of a portion of the latch system.

Now referring to FIG. 9, FIG. 9 shows another exploded perspective view of a portion of latch system 20. In particular, catch member 28 along with swing lever 68 and sear element 70 have now been coupled to first housing element 24. In addition, a retainer element 124 outwardly biased by a spring 126 is installed in receptacle 104 formed in first housing element 24. In an embodiment, housing 22 (FIG. 1) is sized and shaped to fit into one of passages 54 (FIG. 4) formed in container 34 (FIG. 2). Retainer element 124 is outwardly spring biased to retain, i.e., lock, latch system 20 in passage 54. In alternative configurations, latch system 20 need not include retainer element 124 and spring 126, but may instead have another structure for fastening latch system 20 into or on a container, cupboard, gate, or any other suitable enclosure.

The exploded perspective view of FIG. 9 additionally reveals a ball 128 for installation into cavity 105 in pocket 106 of actuation lock 108. A pocket cover 130 is coupled to pocket 106 via threaded fasteners 132. In general, actuation lock 108 that includes pocket 106, ball 128, and pocket cover 130 functions to disable a manual unlatching feature of latch system 20 when apparatus 32 (FIG. 2) is tilted or tipped away from an upright position. Such an event can occur when an animal, such as a bear, tips apparatus 32 when trying to access the contents of container 34 (FIG. 2). The function of actuation lock 108 will be demonstrated in connection with FIGS. 17 and 18.

Now referring to catch member 28, shown in FIG. 9, a lateral surface 134 of catch member 28 has a cam 136 formed thereon. Cam 136 extends outwardly from lateral surface 134. Cam 136 transforms a rotational, or pivoting, motion of catch member 28 into a translational motion of a sear retainer (not shown) of latch system 20. This function will be demonstrated in connection with FIGS. 14 and 15.

Figure 10:
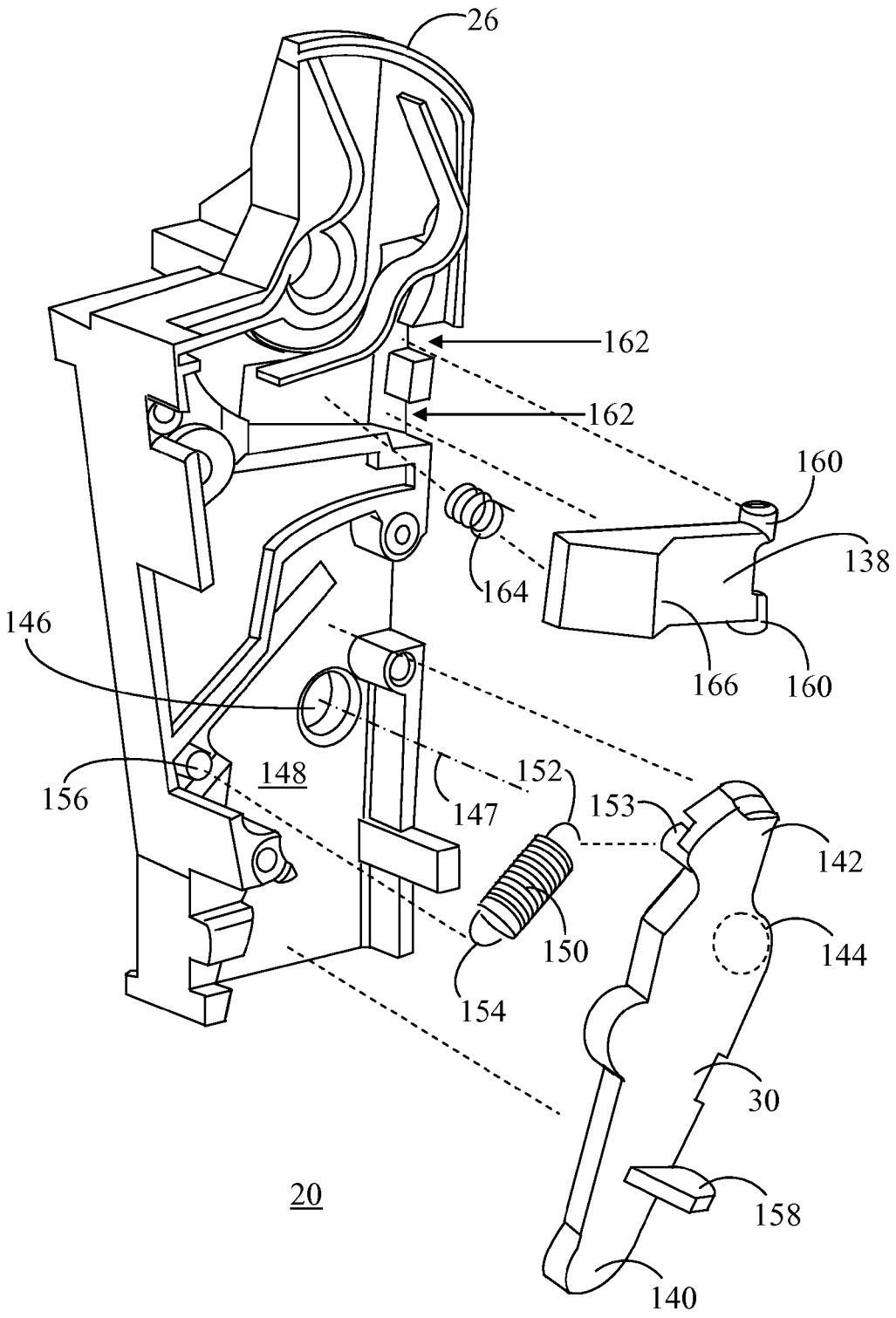
FIG. 10 shows another exploded perspective view of a portion of the latch system.

FIG. 10 shows another exploded perspective view of a portion of latch system 20. In this illustration, some components of latch system 20 and their interaction with second housing element 26 are visible. In particular, the design of manual actuation lever 30 is revealed. Latch system 20 additionally includes a sear retainer 138.

Manual actuation lever 30 includes an actuation end 140 configured to extend out of housing 22 (see FIG. 1) and an engagement end 142. A pivot member 144 (shown in dashed line form) is interposed between actuation end 140 and engagement end 142. Pivot member 144 extends outwardly from manual actuation lever 30 and engages with a pivot receiver 146 formed in second housing element 26. Pivot member 144 defines a pivot axis 147 about which manual actuation lever 30 is able to pivot. That is, manipulation of actuation end 140 causes manual actuation lever 30 to pivot about pivot axis 147. This function will be demonstrated in connection with FIG. 16.

Manual actuation lever 30 is coupled to an inner surface 148 of second housing element 26 via a spring 150. For example, a first end 152 of spring 150 is engaged with a post 153 extending outwardly from manual actuation lever 30 and a second end 154 of spring 150 is engaged with a post 156 extending outwardly from inner surface 148 of second housing element 26. Accordingly, after manual actuation lever 30 is manipulated, it will return to its original position through a spring force imparted by way of spring 150.

Manual actuation lever 30 further includes a bumper 158 extending outwardly from a side of lever 30. When latch system 20 is assembled, bumper 158 extends into cavity 105 (FIG. 7) of pocket 106 (FIG. 7). Under certain conditions, bumper 158 abuts ball 128 (FIG. 9) of actuation lock 108 (FIG. 9) to prevent movement of manual actuation lever 30. This function will be demonstrated in connection with FIGS. 17 and 18.

Sear retainer 138 includes post elements 160 shaped to reside in socket areas 162 of second housing element 26. A spring 164 is installed between inner surface 148 of second housing element 26 and sear retainer 138 so that sear retainer 138 is biased outwardly from inner surface 148. As such, when latch system 20 is assembled, sear retainer 138 is spring biased to move toward lateral surface 134 (FIG. 9) of catch member 28. An extension portion 166 of sear retainer 138 can thus abut catch member 28 and to slide over cam 136 (FIG. 9) as catch member 28 pivots. This feature will be demonstrated in connection with FIGS. 14 and 15.

Latch system 20 has a number of operational modes or positions. In one operational mode, inertial locking mechanism 95 (FIG. 7) of latch system 20 may be in a locked position so that catch member 28 is locked and unable to pivot, i.e., catch member 28 is in a latch position. In another operational mode, inertial locking mechanism 95 may be in an unlocked position, but catch member 28 has not yet pivoted. Therefore, although inertial locking mechanism 95 is in an unlocked position, catch member 28 is still in the latch position. In yet another operational mode, inertial locking mechanism 95 may be in an unlocked position and catch member 28 has now pivoted to a release position. The terms "locked position" and "unlocked position" used herein relate to the relative positions of swing lever 68 and sear element 70 of inertial locking mechanism 95. Whereas the terms "latch position" and "release position" used herein relate to the relative position of catch member 28.

FIGS. 11-15 are described herein to demonstrate the various operational modes of latch system 20. In FIGS. 11-15, housing 22 (FIG. 1), the components of actuation lock 108 (FIG. 9) and retainer element 124 (FIG. 9) have been removed for clarity.

Figure 11:
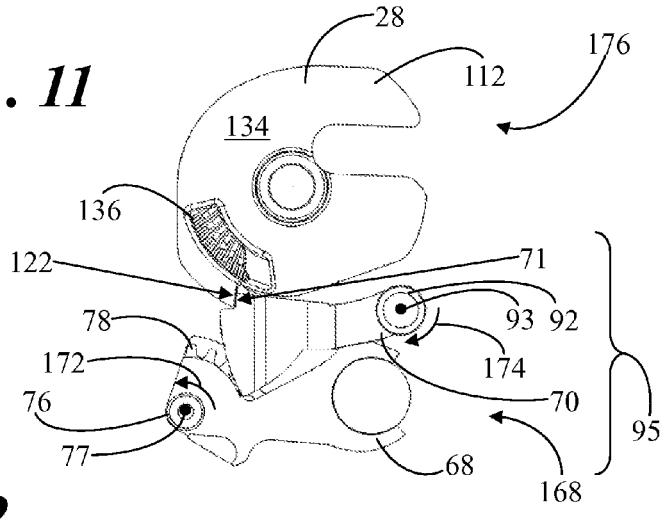
FIG. 11 shows a partial side view of an inertial locking mechanism of the latch system in a locked position.
Figure 12:
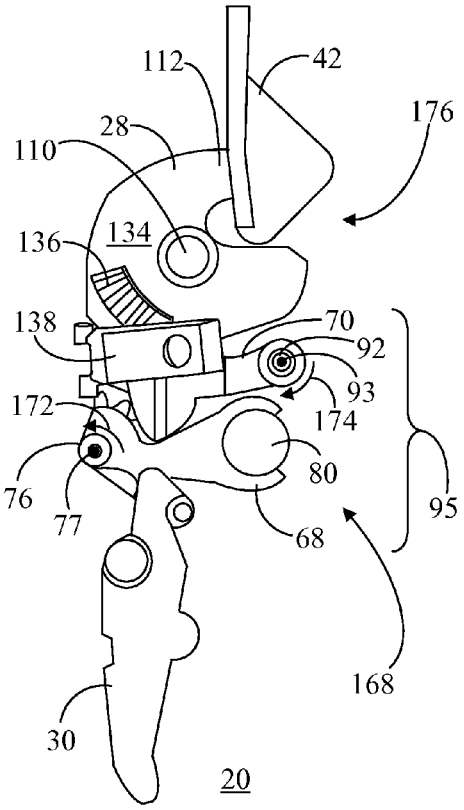
FIG. 12 shows a partial side view of the inertial locking mechanism of the latch system in the locked position, with a catch member being engaged with a latch receptacle in the apparatus of FIG. 2.

Referring to FIGS. 11 and 12, FIG. 11 shows a partial side view of inertial locking mechanism 95 of latch system 20 in a locked position 168, and FIG. 12 shows a partial side view of inertial locking mechanism 95 of latch system 20 in locked position 168 with catch member 28 being engaged with latch receptacle 42 of apparatus 32 (FIG. 2). When inertial locking mechanism 95 is in locked position 168, latch area 71 of sear element 70 is in direct contact with engagement area 122 of catch member 28. In FIG. 11, sear retainer 138 is not shown in order to visualize the contact of sear element 70 with catch member 28.

When spring lever 68 pivots in, for example, a counterclockwise direction 172, about pivot axis 77 at pivot shaft 76, sear element 70 moves commensurately, in the opposite direction, e.g., a clockwise direction 174, about pivot axis 93 at pivot shaft 92 due to the geared engagement of gear teeth 78 on spring lever 68 with gear teeth 96 (see FIG. 7) on sear element 70. Thus, latch area 71 of sear element 70 is engaged with engagement area 122 so that catch member 28 is placed in a latch position 176 in which it is unable to pivot.

The locked position 168 of inertial locking mechanism 95 and the resulting latch position 176 of catch member 28 will occur when closure element 38 (FIG. 2) is closed on container 34 (FIG. 2). This operational mode is the default mode of latch system 20 and occurs automatically due to a spring force imposed on spring lever 68 by spring 82 (FIG. 7). This spring force causes spring lever 68 to pivot into locked position 168 so that sear element 70 is urged into substantially continuous engagement with catch member 28 in the absence of an acceleration event (discussed below). Therefore, spring lever 68 is biased toward the resulting latch position 176 of catch member 28 by spring 82 so that hook 112 of catch member 28 engages with latch receptacle 42. In such a configuration, bears and other animals cannot readily access the contents of container 34.

Figure 13:
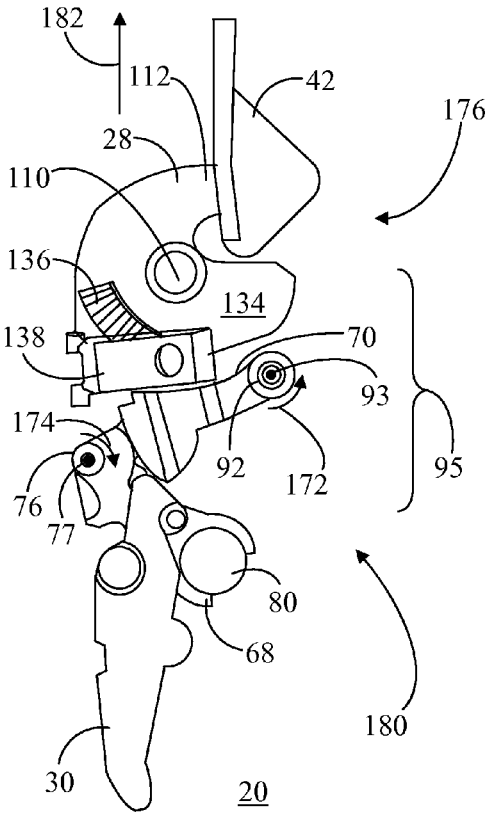
FIG. 13 shows a partial side view of the inertial locking mechanism of the latch system in an unlocked position with the catch member still being engaged with the latch receptacle.

FIG. 13 shows a partial side view of inertial locking mechanism 95 of latch system 20 in an unlocked position 180, with catch member 28 still being engaged with latch receptacle 42. Unlocked position 180 of inertial locking mechanism 95 can occur when apparatus 32 (FIG. 2) is either lifted sharply by, for example, the automated, mechanical gripping arm of a truck or when apparatus 32 is briefly shaken by the gripping arm of the truck. The lifting action by the truck and/or the shaking action by the truck are referred to herein an acceleration event. An acceleration event is represented by an arrow 182 in FIG. 13.

In response to acceleration event 182, swing lever 68 pivots in clockwise direction 174 as a result of the presence of weight 80 located distally from the pivot axis at pivot shaft 76. That is, weight 80 on swing lever 68 tends to stay in its rest position relative to latch system 20 within apparatus 32 (FIG. 2) which moves generally independently from weight 80. Enough energy is extracted with this difference in motion to move inertial locking mechanism 95 into unlocked position 180. Accordingly, due to the geared engagement of swing lever 68 and sear element 70, sear element 70 pivots in the opposite direction, i.e., in counterclockwise direction 172 such that latch area 71 of sear element 70 is disengaged from engagement area 122 (visible in FIG. 11) of catch member 28.

At the bottom of the swing lever's 68 stroke, i.e., at its maximum amount of movement in clockwise direction 174, sear retainer 138 snaps into a position between catch member 28 and sear element 70 so that sear element 70 and swing lever 68 are temporarily prevented from returning to locked position 168. It should be recalled that spring loaded plunger 118 (FIG. 8) extends outwardly from catch member 28. Once sear retainer 138 snaps into position between catch member 28 and sear element 70, catch member 28 can be pivoted against the resistance of plunger 118. However, catch member 28 will remain in latch position 176 until apparatus 32 (FIG. 2) and consequently latch system 20 is upended.

Figure 14:
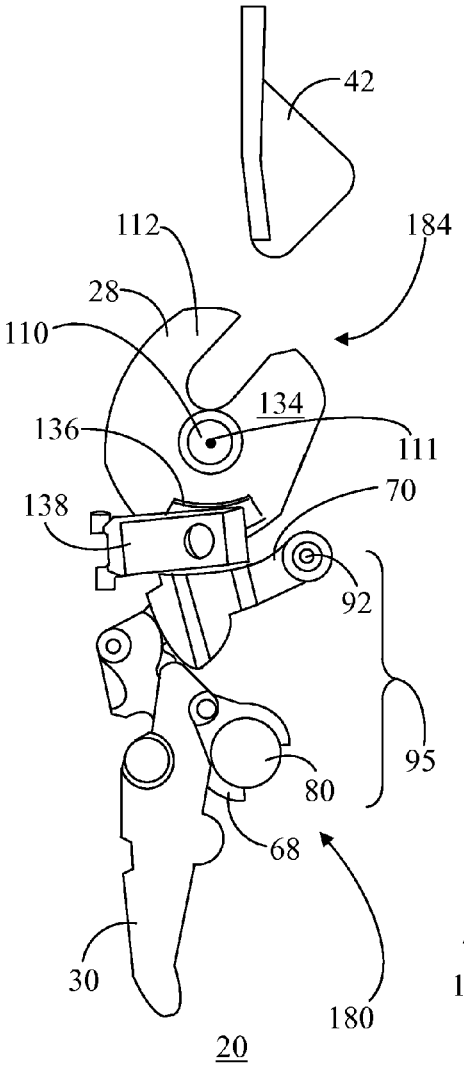
FIG. 14 shows a partial side view of the inertial locking mechanism of the latch system in the unlocked position with the catch member being disengaged from the latch receptacle.
Figure 15:
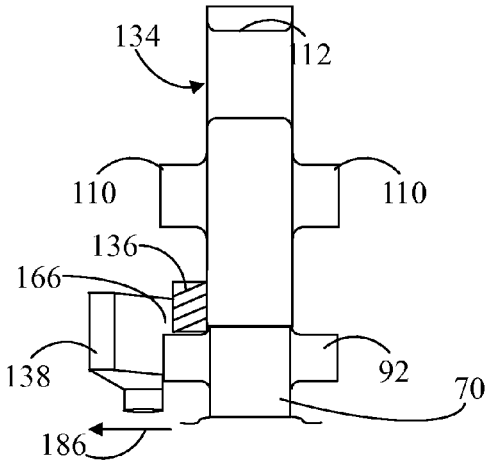
FIG. 15 shows a partial front view demonstrating the functional interaction between components when the catch member of the latch system is in a release position.

Referring to FIGS. 14 and 15, FIG. 14 shows a partial side view of inertial locking mechanism 95 of latch system 20 in unlocked position 180 with catch member 28 now being disengaged from latch receptacle 42, and FIG. 15 shows a partial front view demonstrating the functional interaction between components when catch member 28 is in a release position 184. It should be readily recalled from the discussion of FIG. 13 that although inertial locking mechanism 95 is in unlocked position 180, catch member 28 remains in latch position 176 until apparatus 32 is upended.

However, as now represented by FIGS. 14 and 15, apparatus 32 has been upended by, for example, the mechanical gripping arm of a truck. When apparatus 32 is upended, the weight of lid 38 (FIG. 2) is heavy enough to cause catch member 28 to rotate about pivot axis 111 at catch pivot 110 to release position 184 so that lid 38 falls open. Of course, since latch receptacle 42 is attached to lid 38, latch receptacle 42 moves out of contact with catch member 28 as lid 38 falls open. The contents of container 34 can now be emptied into the truck while lid 38 is open.

As catch member 28 swings, i.e., pivots about pivot axis 111, from latch position 176 (FIG. 12) to release position 184, extension portion 166 of sear retainer 138 comes into contact with and slides over cam 136. Cam 136 pushes sear retainer 138 outwardly, as represented by an arrow 186, from lateral surface 134 of catch member 28 and thus moves sear retainer 138 out of the way. With sear retainer 138 displaced outwardly, the spring force imposed on spring lever 68 by spring 82 (FIG. 7) causes spring lever 68 to pivot in counterclockwise direction 172 (FIG. 12) so that through their geared engagement, sear element 70 pivots in clockwise direction 174 (FIG. 12). Accordingly, inertial locking mechanism 95 returns to locked position 168 even while catch member 28 is still in release position 184.

When apparatus 32 is returned to its upright position, closure element 38 closes and latch receptacle 42 strikes catch member 28. The force from latch receptacle 42 causes catch member 28 to engage with latch receptacle 42 and rotate about pivot axis 111 back to latch position 176 (FIG. 12). Since spring lever 68 and sear element 70 have already automatically returned to locked position 168 and sear retainer 134 has been pushed out of the way by cam 136, latch area 71 of sear element 70 can again re-engage with engagement area 122 of catch member 28. Thus, catch member 28 returns to latch position 176 and is additionally unable to pivot, as demonstrated in FIG. 12.

It should be recalled that first housing element 24 includes detents 98 and 100 (FIG. 7) and catch member 28 includes spring-loaded plunger 118 (FIG. 8). Interconnection of plunger 118 with detent 98 temporarily keeps catch member 28 in release position 184 while apparatus 32 is upended. Detent 100 mitigates the potential for a premature movement of catch member 28 from latch position 176 (FIG. 12) to release position 184. That is, interconnection of plunger 118 with detent 100 temporarily keeps catch member 28 in latch position 176 when apparatus 32 is subjected to minor vibrations and movements prior to apparatus 32 being upended.

Figure 16:
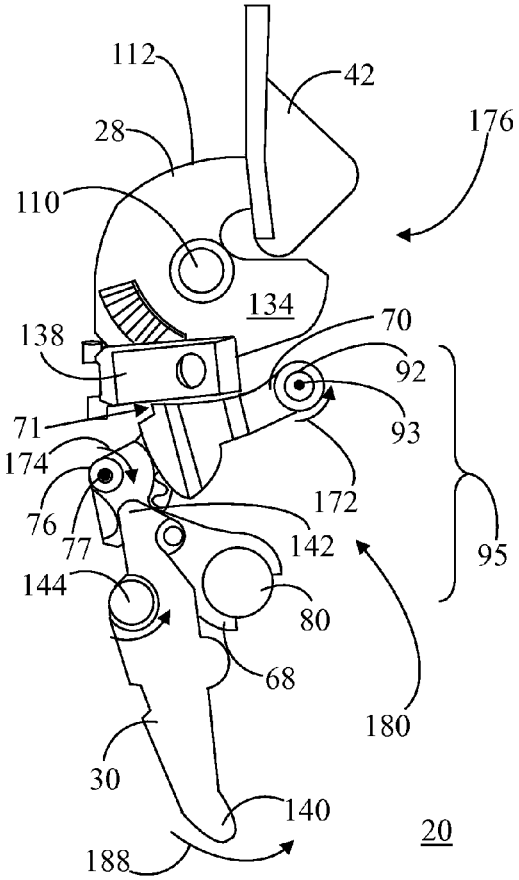
FIG. 16 shows a partial side view of the latch system being actuated utilizing a manual actuation lever.

FIG. 16 shows a partial side view of latch system 20 being actuated utilizing manual actuation lever 30. Although latch system 20 is implemented to retain lid 38 (FIG. 2) secured to container 34 (FIG. 2), there are situations in which a user may wish to place an item, e.g., refuse 50 (FIG. 2), into container 34. Accordingly, manual actuation lever 30 enables a user to manually place inertial locking mechanism 95 in unlocked position 180 (FIG. 13) so that catch member 28 can swing to release position 184 (FIG. 14) as lid 38 is lifted by the user.

In order to initiate a manual release, actuation end 140 of manual actuation lever 30 is manipulated by a user, as indicated by an arrow 188. The manipulation of manual actuation lever 30 causes lever 30 to pivot about pivot axis 147 at pivot member 144 so as to move engagement end 142 of manual activation lever 30 into contact with swing lever 68. Swing lever 68 is thus urged to pivot in clockwise direction 174 so that sear element 70 pivots in counterclockwise direction 172 again causing sear element 70 to move out of engagement with catch member 28, thereby releasing catch member 28 and enabling catch member 28 to move to release position 184 (FIG. 14) when the user lifts lid 38.

Apparatus 32 (FIG. 2) having latch system 20 is discussed in connection with larger animals such as bears attempting to gain access to the contents of apparatus 32. However, such contents may be as great of a temptation to smaller animals, such as raccoons, squirrels, and the like. Raccoons can be especially problematic due to their intelligence, their ability to derive and remember solutions, and their extremely dexterous front paws. Although these smaller animals may not be able to reach manual actuation lever 30 when apparatus 32 is in an upright position, apparatus 32 could get tipped over by a larger animal, the wind, a vehicle, and so forth. When apparatus 32 is in a tipped over position, it is possible that a smaller persistent animal, such as a raccoon, may attempt to manipulate manual actuation lever 30 in order to gain access into apparatus 32. Accordingly, in some embodiments, latch system 20 includes actuation lock 108 so that even if an animal attempts to manipulate manual actuation lever 30, it will not be able to gain access into apparatus 32.

Figure 17:
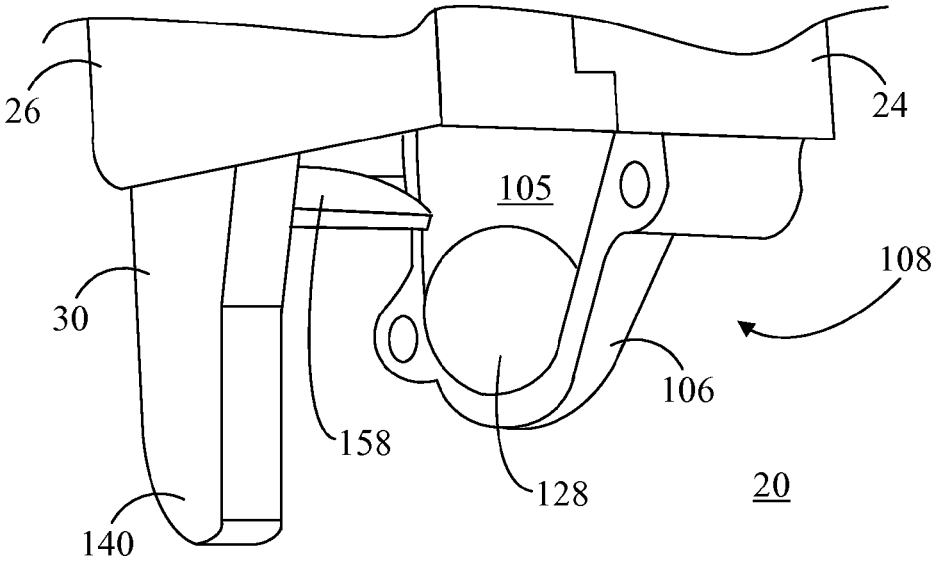
FIG. 17 shows a partial perspective view of an actuation lock feature incorporated into the latch system.
Figure 18:
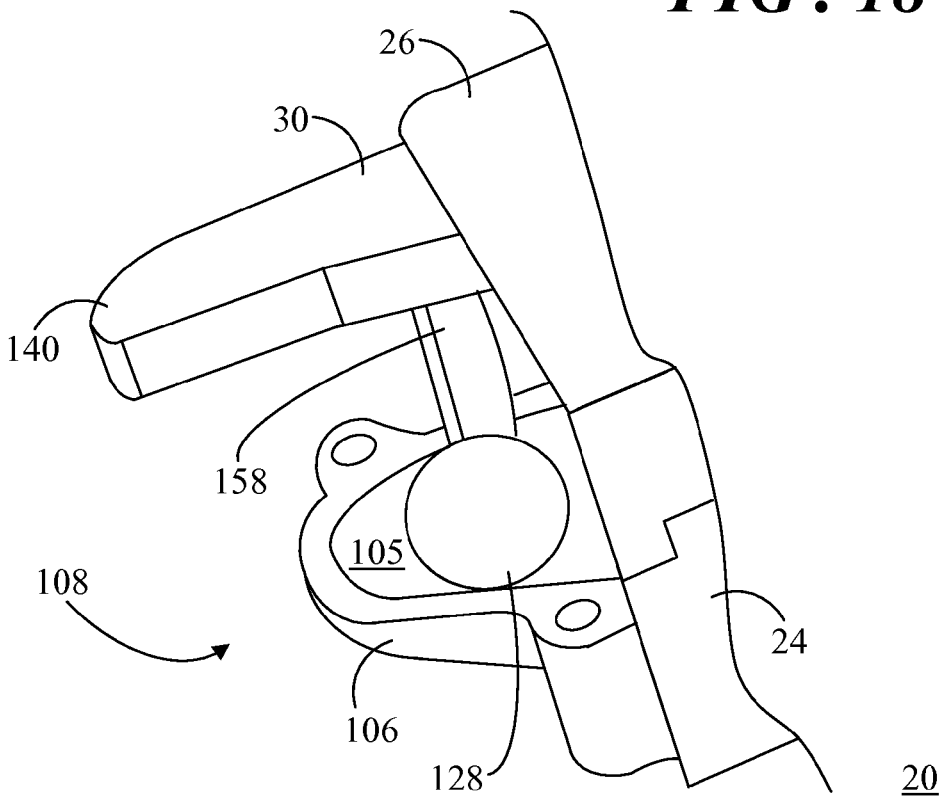
FIG. 18 shows a partial perspective view of the actuation lock feature in a position that prevents actuation of manual actuation lever when the apparatus of FIG. 2 is moved away from an upright position.

Referring to FIGS. 17 and 18, FIG. 17 shows a partial perspective view of actuation lock 108 incorporated into latch system 20, and FIG. 18 shows a partial perspective view of actuation lock 108 in a position that prevents actuation of manual actuation lever 30 when apparatus 32 (FIG. 2) is tipped, i.e., moved away from an upright position. It should be recalled that actuation lock 108 includes pocket 106 and pocket cover 130 (FIG. 9) fastened thereto. Ball 128 is configured to roll in cavity 105 of pocket 106. For clarity, pocket cover 130 is not shown in FIGS. 17 and 18 so that movement of ball 128 can be more readily visualized.

Bumper 158 of manual actuation lever 30 extends into cavity 105 of pocket 106. When apparatus 32 is in an upright position, ball 128 rolls to the bottommost position within cavity 105 due to the effect of gravity. Thus, bumper 158 is able to move over ball 128 in pocket 106 when actuation end 140 of manual actuation lever 30 is manipulated by a user, as discussed above in connection with FIG. 16. This upright configuration of apparatus 32 and the corresponding position of ball 128 is represented by FIG. 17.

When apparatus 32 is moved away from the upright position, for example, when apparatus 32 is tipped over, ball 128 rolls to the lowermost intermediate position within cavity 105 of pocket 106. In such a position, when actuation end 140 of manual actuation lever 30 is manipulated by, for example, a raccoon, bumper 158 abuts or strikes ball 128. Therefore, manual actuation lever 30 is prevented from movement so that any possible manipulation of lever 30 cannot urge inertial locking mechanism 95 into unlocked position 180 (FIG. 13). This tipped configuration of apparatus 32 and the corresponding position of ball 128 is represented by FIG. 18.

Thus, actuation lock 108 largely prevents unwanted intruders from gaining access to the contents of apparatus 32. Alternative designs may not call for the preventing smaller animals from getting into an apparatus that includes latch system 20. Therefore, alternative embodiments may not include actuation lock 108.

In summary, embodiments entail a latch system for an enclosure, such as a container with a lid, and an apparatus that includes a container and a lid having the latch system incorporated therein. The latch system includes an inertial lock mechanism that includes a swing lever in geared engagement with a sear element. The sear element is typically engaged with a catch member that engages with a latch receptacle fastened to the closure element. When the latch system is subjected to an acceleration event, such as being sharply lifted or briefly shaken, a weight on the end of the swing lever causes the swing lever to pivot in one direction. Therefore, the sear element rotates in the opposing direction due to its geared engagement with the swing lever. This pivoting action moves sear element out of engagement with the catch member, thereby enabling the catch member to swing to a release position so that the lid having the latch receptacle can open. Thus, the latch system automatically unlatches when the container is sharply lifted or briefly shaken so that contents of the container can be accessed. The latch system then automatically re-engages when the container is returned to its upright position. The latch system can further include an actuation lock that prevents manual actuation of the latch system by an unwanted intruder when the apparatus having the latch system is tilted, tipped, or otherwise moved away from an upright position.

Although the preferred embodiments of the invention have been illustrated and described in detail, it will be readily apparent to those skilled in the art that various modifications may be made therein without departing from the spirit of the invention or from the scope of the appended claims. For example, the lock system may be implemented to allow controlled access to a multitude of container designs, cupboards, gates, and the like. Additionally, other designs for the actuation lock may be adapted to react to tipping movement of the container and subsequently prevent release of the locking mechanism so that an intruder cannot gain entry into the apparatus.

What is claimed is:

1. A latch system comprising:

a catch member capable of swinging between a latch position and a release position;

a sear element engaged with said catch member when said catch member is in said latch position, said sear element including first gear teeth; and a swing lever having second gear teeth and a weight, wherein said second gear teeth are engaged with said first gear teeth of said sear element, and wherein said weight provides resistance to an acceleration event and causes said swing lever to pivot in a first direction in response to the acceleration event to cause said sear element to pivot in a second direction opposing said first direction thereby disengaging from said catch member such that said catch member is able to move to said release position.

2. A latch system as claimed in claim 1 wherein said catch member comprises:

a catch pivot for enabling pivotable movement of said catch member between said latch position and said release position; and a hook configured to engage with a latch receptacle in said latch position and to pivot out of engagement with said latch receptacle in said release position, wherein said latch system is configured to lock a closure element to a container, said closure element being movable relative to said container, and said closure element including said latch receptacle.

3. A latch system as claimed in claim 2 wherein said catch member is configured to pivot from said release position into said latch position in response to an imposition of force against said catch member from said closure element.

4. A latch system as claimed in claim 1 further comprising:

a housing in which at least portions of said catch member, said sear element, and said swing lever are located, said housing including at least two detents; and a plunger element extending outwardly from a lateral surface of said catch member, said plunger element being spring biased so as to selectively engage with said at least two detents.

5. A latch system as claimed in claim 1 wherein:

said first gear teeth of said sear element are located at a first end of said sear element, said sear element being pivotable about a first pivot axis located at a second end of said sear element, said second end opposing said first end; and said second gear teeth of said swing lever engaged with said first gear teeth are located proximate a second pivot axis.

6. A latch system as claimed in claim 1 further comprising:

a housing in which at least portions of said catch member, said sear element, and said swing lever are located; and a spring having a first end coupled to said swing lever and having a second end coupled to said housing, wherein said swing lever is biased toward a locked position by said spring to urge said sear element in substantially continuous engagement with said catch member in the absence of said acceleration event.

7. A latch system as claimed in claim 1 wherein:

said catch member includes an engagement area; and said sear element comprises a latch area configured for contact with said engagement area to retain said catch member in said latch position, said latch area moving out of contact with said engagement area in response to said acceleration event.

8. A latch system as claimed in claim 1 further comprising a sear retainer, at least a portion of said sear retainer being interposed between said catch member and said sear element in response to said acceleration event to hold said sear element out of engagement with said catch member.

9. A latch system as claimed in claim 8 wherein said sear retainer is spring biased toward a lateral surface of said catch member.

10. A latch system as claimed in claim 8 wherein said catch member includes a lateral surface having a cam formed thereon, and said sear retainer includes an extension portion configured to slide over said cam, wherein when said catch member swings from said latch position to said release position, said cam pushes said sear retainer outwardly from said lateral surface of said catch member to enable said sear element to pivot in said first direction so that when said catch member swings from said release position to said latch position, said sear element returns into engagement with said catch member.

11. A latch system as claimed in claim 1 further comprising:

a housing in which at least portions of said catch member, said sear element, and said swing lever are located; and a manual actuation lever having first end extending out of said housing, a second end, and a pivot axis interposed between said first and second ends, wherein manipulation of said first end causes said manual actuation lever to pivot about said pivot axis to move said second end into abutment with said swing lever and urge said swing lever to pivot in said first direction thereby enabling said catch member to move to said release position.

12. A latch system as claimed in claim 11 further comprising an actuation lock in communication with said manual actuation lever for preventing movement of said manual actuation lever about said pivot axis when said latch system moves away from an upright position.

13. A latch system as claimed in claim 12 wherein:

said actuation lock comprises a pocket and a ball, said pocket being formed contiguous with said housing proximate said first end of said manual actuation lever, said pocket having a cavity, said ball being configured to roll in said cavity; and said manual actuation lever comprises a bumper extending into said cavity, said bumper being configured to abut said ball when said latch system is moved away from said upright position thereby preventing movement of said manual actuation lever.

14. An apparatus comprising:

a container having an interior volume and an opening;

a closure element covering said opening, said closure element being movable relative to said container;

a latch receptacle secured to said closure element; and a latch system secured to said container and configured to lock said closure element to said container, said latch system including:

a catch member, said catch member including a catch pivot and a hook, said catch pivot enabling pivotable movement of said catch member between a latch position and a release position, and said hook engaging with said latch receptacle in said latch position and pivoting out of engagement with said latch receptacle in said release position;

a sear element engaged with said catch member when said catch member is in said latch position, said sear element including first gear teeth;

a swing lever having second gear teeth engaged with said first gear teeth of said sear element, said swing lever pivoting in a first direction in response to an acceleration event to cause said sear element to pivot in a second direction opposing said first direction thereby disengaging from said catch member such that said catch member is able to pivot to said release position;

a housing in which at least portions of said catch member, said sear element, and said swing lever are located; and a spring having a first end coupled to said swing lever and having a second end coupled to said housing, wherein said swing lever is biased toward a locked position by said spring to urge said sear element in substantially continuous engagement with said catch member in the absence of said acceleration event.

15. An apparatus as claimed in claim 14 further comprising a manual actuation lever having a first end extending out of said housing, a second end, and a pivot axis interposed between said first and second ends, wherein manipulation of said first end causes said manual actuation lever to pivot about said pivot axis to move said second end into abutment with said swing lever and urge said swing lever to pivot in said first direction thereby enabling said catch member to move to said release position.

16. An apparatus as claimed in claim 15 further comprising an actuation lock in communication with said manual actuation lever for preventing movement of said manual actuation lever about said pivot axis when said latch mechanism moves away from an upright position.

17. A latch system comprising:

a catch member capable of swinging between a latch position and a release position;

a sear element engaged with said catch member when said catch member is in said latch position, said sear element including first gear teeth located at a first end of said sear element, said sear element being pivotable about a first pivot axis located at a second end of said sear element, said second end opposing said first end; and a swing lever, said swing lever including a third end and a fourth end opposing said third end, said third end being pivotable about a second pivot axis, said swing lever further including second gear teeth and a weight, said second gear teeth being located proximate said second pivot axis, said fourth end including said weight, and said second gear teeth being in geared engagement with said first gear teeth, wherein said weight provides resistance to an acceleration event to cause said swing lever to pivot about said second pivot axis in a first direction so that said sear element pivots in a second direction opposing said first direction thereby releasing said catch member such that said catch member is able to move to said release position.

18. A latch system as claimed in claim 17 wherein:

said catch member includes an engagement area; and said sear element comprises a latch area configured for contact with said engagement area to retain said catch member in said latch position, said latch area moving out of contact with said engagement area in response to said acceleration event.

19. A latch system as claimed in claim 17 further comprising a sear retainer, at least a portion of said sear retainer being interposed between said catch member and said sear element in response to said acceleration event to hold said sear element out of engagement with said catch member.

* * * * *